US010039360B2

(12) United States Patent
Tsai

(10) Patent No.: US 10,039,360 B2
(45) Date of Patent: Aug. 7, 2018

(54) BELONGINGS POCKET

(71) Applicant: Cheng-Han Tsai, Taoyuan (TW)

(72) Inventor: Cheng-Han Tsai, Taoyuan (TW)

( * ) Notice: Subject to any disclaimer, the term of this patent is extended or adjusted under 35 U.S.C. 154(b) by 3 days.

(21) Appl. No.: 15/210,404

(22) Filed: Jul. 14, 2016

(65) Prior Publication Data

US 2017/0188678 A1 Jul. 6, 2017

(30) Foreign Application Priority Data

Jan. 6, 2016 (TW) ..... 105200104 U

(51) Int. Cl.
*A45C 13/08* (2006.01)
*A45C 11/18* (2006.01)
*A45C 13/10* (2006.01)

(52) U.S. Cl.
CPC ..... *A45C 13/08* (2013.01); *A45C 11/18* (2013.01); *A45C 13/10* (2013.01); *A45C 13/103* (2013.01); *A45C 13/1069* (2013.01); *A45C 2013/1015* (2013.01)

(58) Field of Classification Search
CPC ..... A45C 11/14; A45C 13/1069; A45C 13/08
USPC ..... 150/100, 150; 206/818
See application file for complete search history.

(56) References Cited

U.S. PATENT DOCUMENTS 2,122,171 A * 6/1938 Alexander ..... A42B 1/006 2/209.12
4,823,943 A * 4/1989 Chang ..... A45C 11/005 150/143
5,388,439 A * 2/1995 Miller ..... A44B 15/005 206/37.1
6,071,010 A * 6/2000 Chan ..... B65D 31/00 383/2
6,286,736 B1 * 9/2001 Angus ..... A45C 1/04 224/236
6,796,344 B2 * 9/2004 Chen ..... A45C 1/024 150/113
7,293,566 B2 * 11/2007 Thall ..... A45D 8/40 132/274
7,806,309 B2 * 10/2010 Korchmar ..... A45C 3/06 224/183
8,628,242 B2 * 1/2014 Buller ..... A45C 7/0077 383/2
9,038,679 B2 * 5/2015 Marquez-Bottome ... A45C 3/08 150/103
2011/0000590 A1 * 1/2011 Welch ..... A45C 3/06 150/104
2015/0305463 A1 * 10/2015 Huyke-Phillips ..... D05B 23/00 150/127

* cited by examiner

*Primary Examiner* — Sue A Weaver
(74) *Attorney, Agent, or Firm* — Schmeiser, Olsen & Watts, LLP

(57) ABSTRACT

A belongings pocket contains: a body, a first magnet, and a second magnet. The body includes a straight fringe and a semi-circular fringe which form the body in a semi-circle shape, and the body also includes a surface fabric, a flexible lining fabric, and an accommodation space in which an opening is defined. The first magnet and the second magnet are arranged beside two ends of the straight fringe of the body. In operation, the body is expanded flatly or the straight fringe of the body is folded in half, and two ends of the body are connected together, after the first magnet and the second magnet are magnetically attracted with each other. Furthermore, the body is erected by way of the flexible lining fabric.

7 Claims, 6 Drawing Sheets

BELONGINGS POCKET

FIELD OF THE INVENTION

The present invention relates to a belongings pocket which is capable of changing appearance.

BACKGROUND OF THE INVENTION

People bring belongings pockets to accommodate various belongings, such as coins, business cards, and so on.

These belongings pockets have different appearances and patterns, and the belongings pockets are made of various materials. However, they cannot change appearances randomly.

The present invention has arisen to mitigate and/or obviate the afore-described disadvantages.

SUMMARY OF THE INVENTION

The primary objective of the present invention is to provide a belongings pocket which is capable of changing appearance and accommodating objects (such as a lucky note) or personal belongings.

To obtain the above objective, a belongings pocket provided by the present invention contains: a body, a first magnet, and a second magnet.

The body includes a straight fringe and a semi-circular fringe which form the body in a semi-circle shape, and the body also includes a surface fabric, a flexible lining fabric, and an accommodation space in which an opening is defined. The first magnet and the second magnet are arranged beside two ends of the straight fringe of the body.

In operation, the body is expanded flatly or the straight fringe of the body is folded in half, and two ends of the body are connected together, after the first magnet and the second magnet are magnetically attracted with each other. Furthermore, the body is erected by way of the flexible lining fabric.

Preferably, the first magnet and the second magnet are housed in the flexible lining fabric.

Preferably, the flexible lining fabric has a first orifice corresponding to the first magnet, and the flexible lining fabric also has a second orifice corresponding to the second magnet, such that the first magnet is housed in the first orifice, and the second magnet is accommodated in the second orifice.

Preferably, each of the first orifice and the second orifice has two fixing pieces mounted on a peripheral side and a bottom thereof, respectively, so as to fix each of the first magnet and the second magnet.

Preferably, the opening of the body has any one of a zipper, a fastener and a hook-and-loop fastener.

Preferably, the body further has a loop fixed thereon.

Preferably, the loop connects with a hanging ring.

DETAILED DESCRIPTION OF THE PREFERRED EMBODIMENTS

Figure 1:
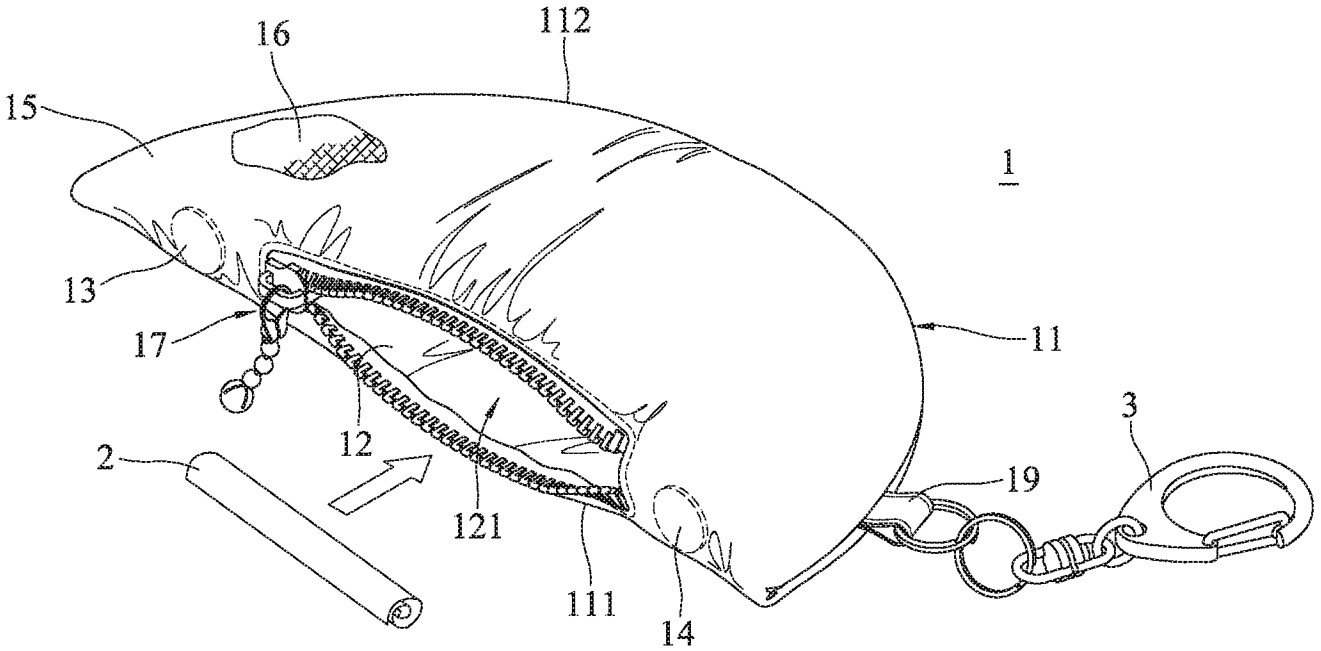
FIG. 1 is a perspective view showing the operation of a belongings pocket according to a preferred embodiment of the present invention.
Figure 2:
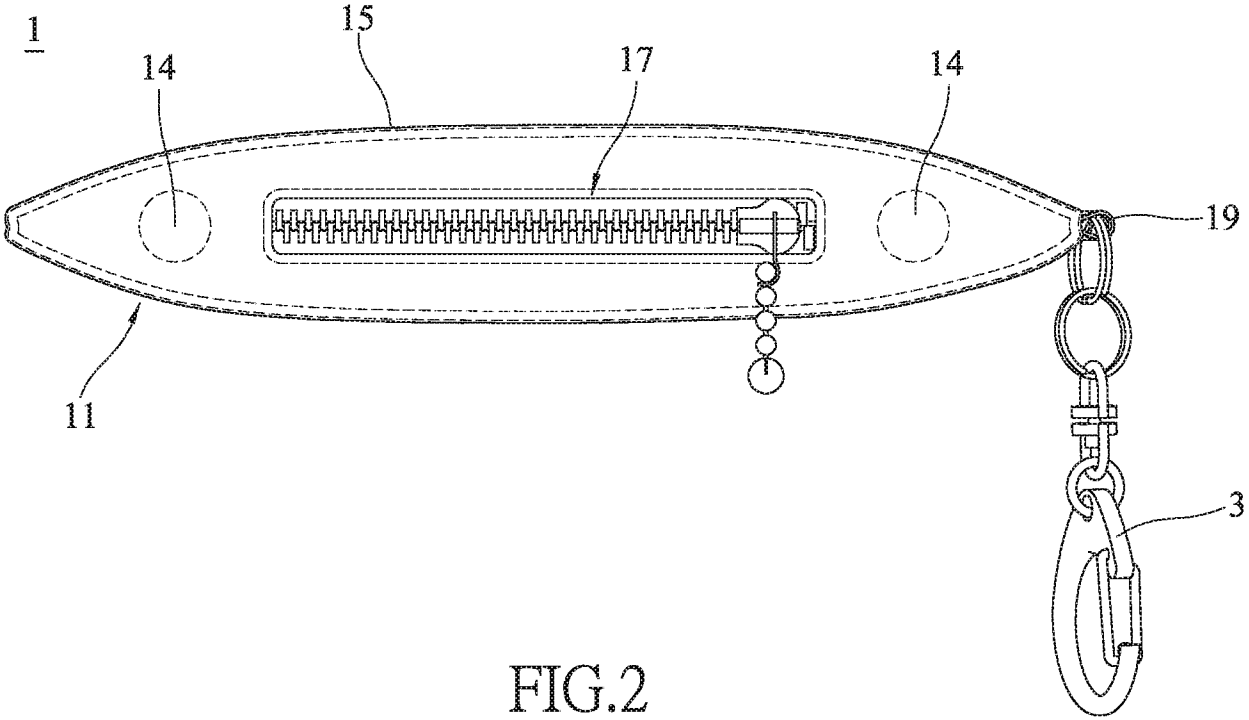
FIG. 2 is another perspective view showing the operation of the belongings pocket according to the preferred embodiment of the present invention.
Figure 3:
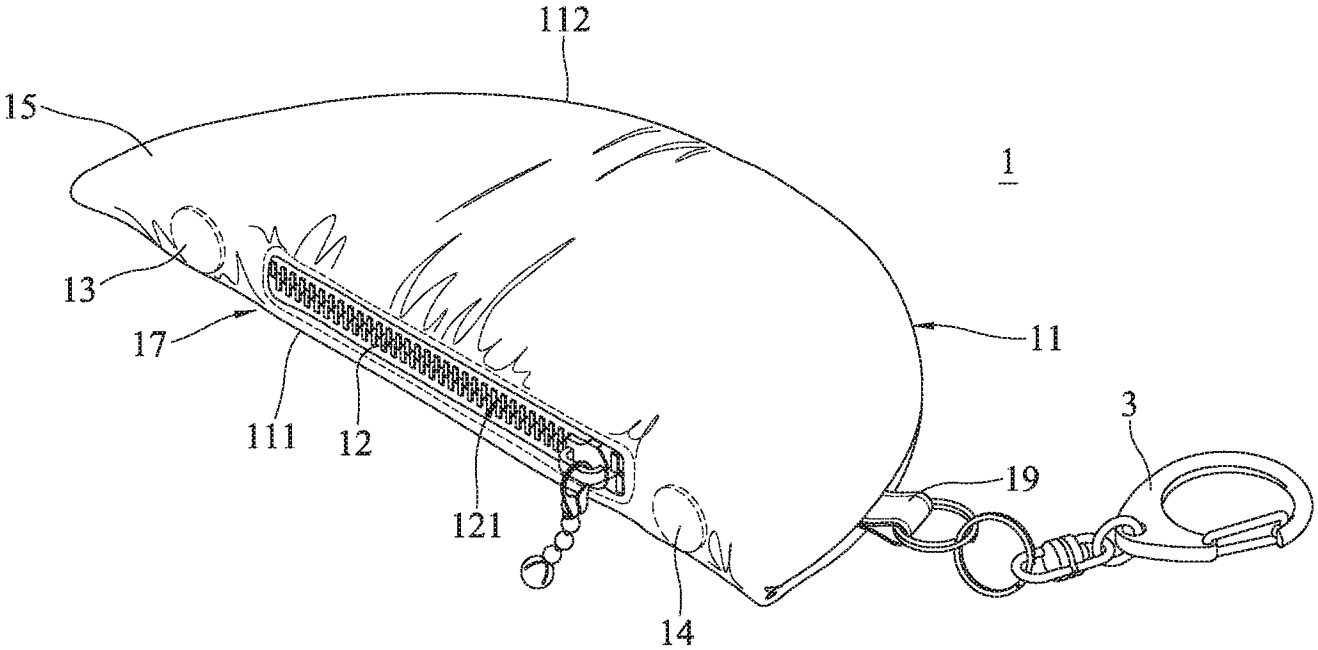
FIG. 3 is also another perspective view showing the operation of the belongings pocket according to the preferred embodiment of the present invention.

With reference to FIGS. 1 to 3, a belongings pocket 1 according to a preferred embodiment of the present invention is capable of changing appearance and comprises: a body 11 configured to accommodate objects (such as a lucky note 2), an accommodation space 12 formed in the body 11 and configured to house personal belongings, a first magnet 13 and a second magnet 14 which are arranged beside two ends of an opening 121 of the accommodation space 12 and magnetically attract with each other.

Preferably, the body 11 of the belongings pocket 1 includes a straight fringe 111 and a semi-circular fringe 112 which form the body 11 in a semi-circle shape, and the body 11 includes a surface fabric 15, a flexible lining fabric 16, and the accommodation space 12 in which the opening 121 is defined. Furthermore, the first magnet 13 and the second magnet 14 are arranged beside two ends of the straight fringe 111 of the body 11.

The flexible lining fabric 16 is made of diving fabric or other flexible fabrics, and the opening 121 of the body 11 has a zipper 17 mounted thereon. In another embodiment, the opening 121 of the body 11 has a fastener or a hook-and-loop fastener mounted thereon.

Figure 4:
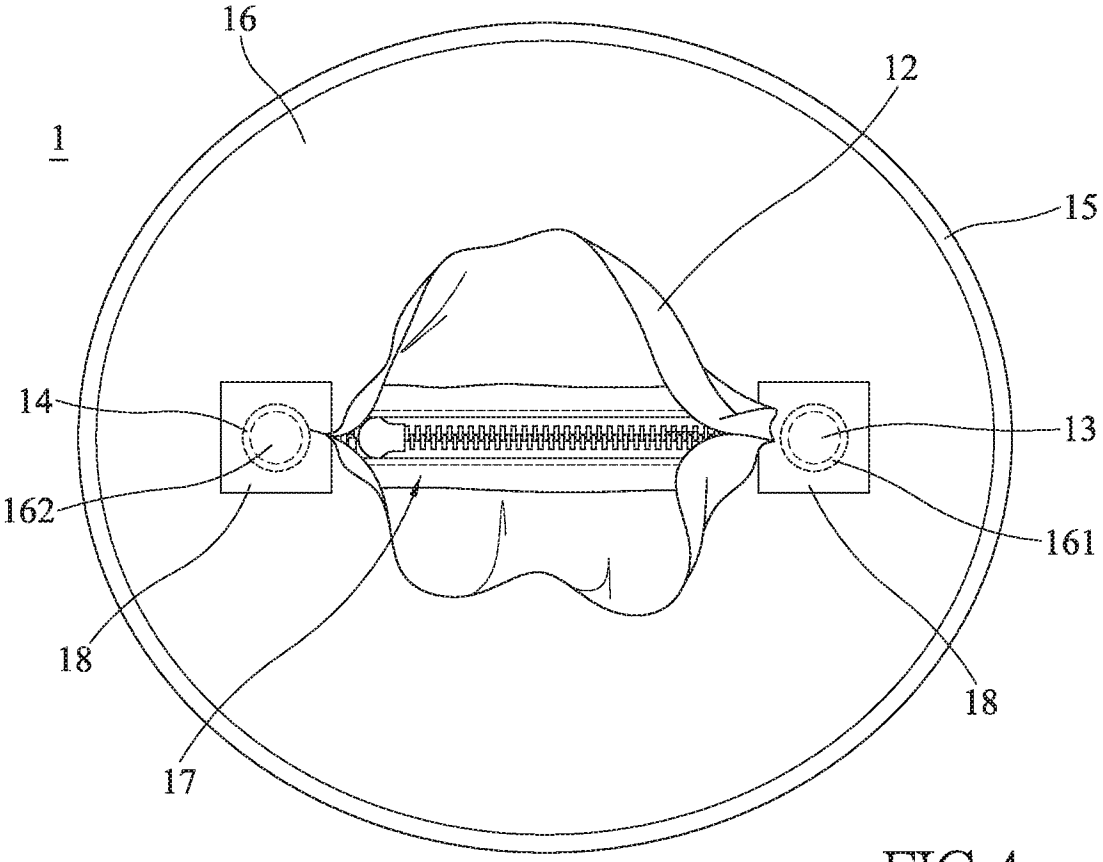
FIG. 4 is a side plane view showing the assembly of the belongings pocket according to the preferred embodiment of the present invention.

Referring to FIG. 4, the first magnet 13 and the second magnet 14 are housed in the flexible lining fabric 16, wherein the flexible lining fabric 16 has a first orifice 161 corresponding to the first magnet 13, and the flexible lining fabric 16 also has a second orifice 162 corresponding to the second magnet 14, such that the first magnet 13 is housed in the first orifice 161, and the second magnet 14 is accommodated in the second orifice 162. Preferably, each of the first orifice 161 and the second orifice 162 has two fixing pieces 18 mounted on a peripheral side and a bottom thereof, respectively, so as to fix each of the first magnet 13 and the second magnet 14.

Figure 5:
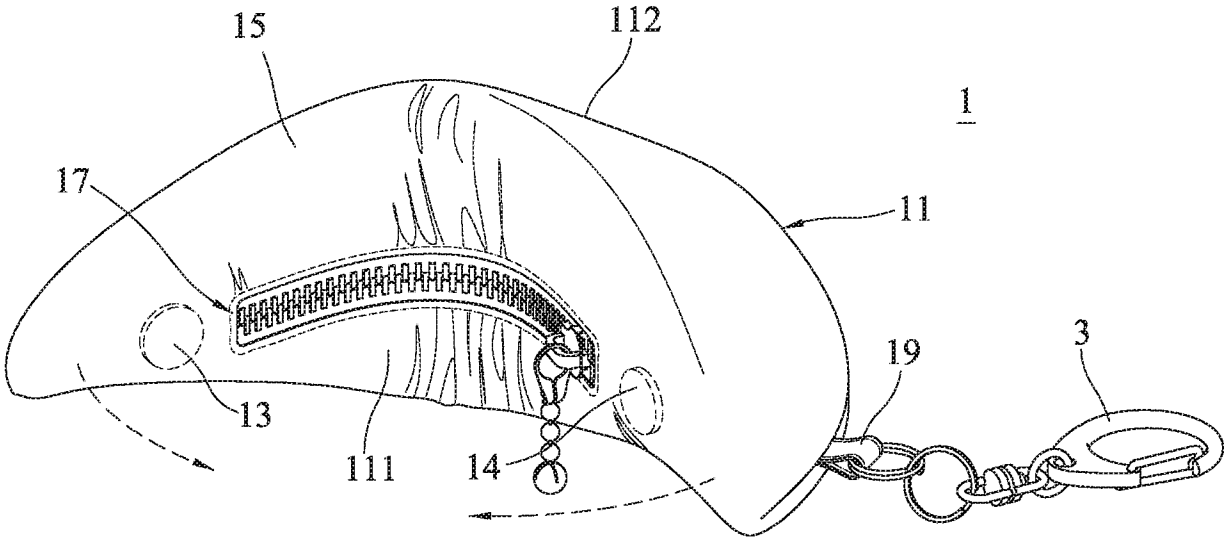
FIG. 5 is still another perspective view showing the operation of the belongings pocket according to the preferred embodiment of the present invention.
Figure 6:
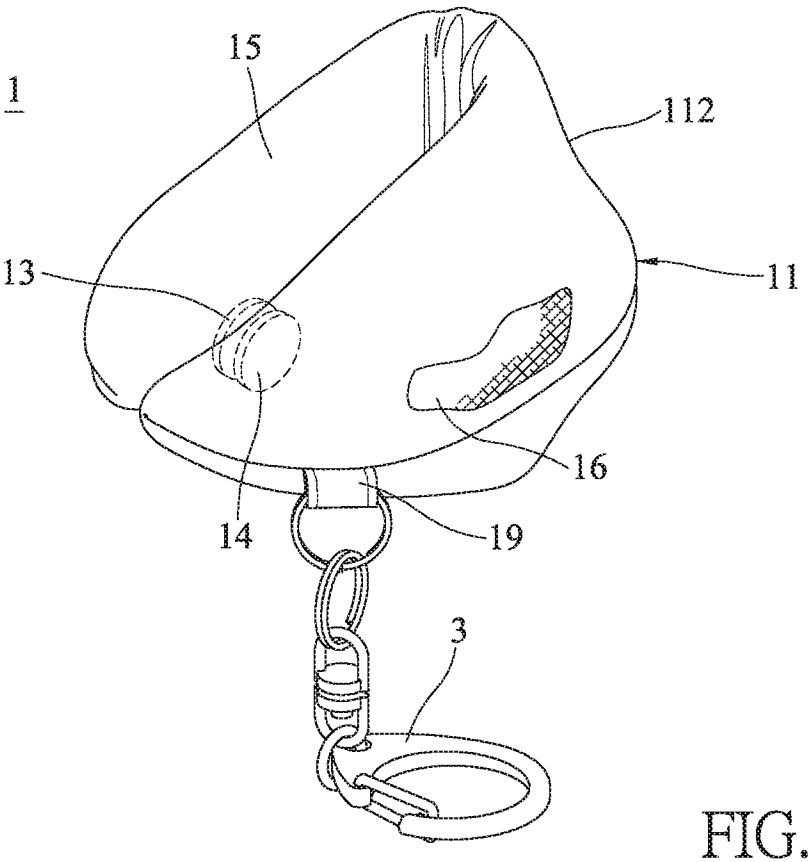
FIG. 6 is another perspective view showing the operation of the belongings pocket according to the preferred embodiment of the present invention.

In operation, as shown in FIG. 2, the body 11 is expanded flatly. As illustrated in FIG. 5, the straight fringe 111 of the body 11 is folded in half, and two ends of the body 11 are connected together, after the first magnet 13 and the second magnet 14 are magnetically attracted with each other. Preferably, the body 11 is erected by way of the flexible lining fabric 16, as illustrated in FIG. 6.

Accordingly, the belongings pocket 1 is capable of accommodating the objects (such as the lucky note 2) or the personal belongings, and its appearance is changed randomly. In addition, the body 11 of the belongings pocket 1 further includes a loop 19 fixed thereon so as to connect with a hanging ring 3.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A belongings pocket comprising:

a body including a straight fringe and a semi-circular fringe which form the body in a semi-circle shape, and the body including a surface fabric, a flexible lining fabric, and an accommodation space in which an opening is defined;

a first magnet and the second magnet which are arranged beside two ends of the straight fringe of the body and magnetically attract with each other;

wherein the body is expanded flatly or the straight fringe of the body is folded in half, and two ends of the body are connected together, after the first magnet and the second magnet are magnetically attracted with each other, and wherein the body is erected by way of the flexible lining fabric.

2. The belongings pocket as claimed in claim 1, wherein the first magnet and the second magnet are housed in the flexible lining fabric.

3. The belongings pocket as claimed in claim 2, wherein the flexible lining fabric has a first orifice corresponding to the first magnet, and the flexible lining fabric also has a second orifice corresponding to the second magnet, such that the first magnet is housed in the first orifice, and the second magnet is accommodated in the second orifice.

4. The belongings pocket as claimed in claim 3, wherein the first orifice has one of two fixing pieces mounted on a peripheral side and a bottom thereof so as to fix the first magnet, and the second orifice has the other fixing piece mounted on peripheral side and a bottom thereof so as to fix the second magnet.

5. The belongings pocket as claimed in claim 1, wherein the opening of the body has any one of a zipper, a fastener and a hook-and-loop fastener.

6. The belongings pocket as claimed in claim 1, wherein the body further has a loop fixed thereon.

7. The belongings pocket as claimed in claim 6, wherein the loop connects with a hanging ring.

* * * * *